US009008545B2

(12) United States Patent
Sakamaki

(10) Patent No.: US 9,008,545 B2
(45) Date of Patent: Apr. 14, 2015

(54) IMAGE FORMING APPARATUS

(75) Inventor: Hideyuki Sakamaki, Chiba (JP)

(73) Assignee: Seiko I Infotech Inc. (JP)

( * ) Notice: Subject to any disclaimer, the term of this patent is extended or adjusted under 35 U.S.C. 154(b) by 108 days.

(21) Appl. No.: 13/805,700

(22) PCT Filed: May 20, 2011

(86) PCT No.: PCT/JP2011/061683

§ 371 (c)(1),
(2), (4) Date: Mar. 5, 2013

(87) PCT Pub. No.: WO2011/162058

PCT Pub. Date: Dec. 29, 2011

(65) Prior Publication Data

US 2013/0188983 A1 Jul. 25, 2013

(30) Foreign Application Priority Data

Jun. 21, 2010 (JP) ..... 2010-140896
May 11, 2011 (JP) ..... 2011-106005

(51) Int. Cl.
*G03G 21/18* (2006.01)
*G03G 15/02* (2006.01)
*G03G 21/16* (2006.01)

(52) U.S. Cl.
CPC ..... *G03G 15/0258* (2013.01); *G03G 15/0283* (2013.01); *G03G 21/1652* (2013.01); *G03G 2221/166* (2013.01); *G03G 2221/1693* (2013.01); *G03G 15/0291* (2013.01); *G03G 21/1814* (2013.01); *G03G 21/1821* (2013.01); *G03G 2215/027* (2013.01)

(58) Field of Classification Search
CPC ..... G03G 15/0283; G03G 21/1652; G03G 21/1821; G03G 2221/166; G03G 2221/1693
USPC ..... 399/90, 115
See application file for complete search history.

(56) References Cited

U.S. PATENT DOCUMENTS

| | | | | |
|---|---|---|---|---|
| 4,386,838 | A * | 6/1983 | Hirabayashi et al. | 399/113 |
| 5,250,992 | A * | 10/1993 | Tsuneeda et al. | 399/172 |
| 6,249,660 | B1 * | 6/2001 | Matsushita et al. | 399/115 |
| 7,043,176 | B1 * | 5/2006 | DeHollander et al. | 399/170 |
| 2006/0233568 | A1 * | 10/2006 | Itabashi et al. | 399/111 |
| 2007/0025755 | A1 * | 2/2007 | Ishikawa et al. | 399/98 |

* cited by examiner

*Primary Examiner* — Benjamin Schmitt
(74) *Attorney, Agent, or Firm* — Adams & Wilks

(57) ABSTRACT

An image forming apparatus has a photosensitive drum, a charger for uniformly charging a surface of the drum, an optical head for irradiating the surface of the drum with light to change a charging state of the drum surface, and a developing device for causing a toner to adhere on the surface of the drum in accordance with the charging state. The charger has a grid with two wire fixing portions each provided with two grooves, a first discharge wire fitted in one of the two grooves of each wire fixing portion, and a second discharge wire fitted in the other of the two grooves of each wire fixing portion. The two grooves of each wire fixing portion are arranged relative to the grid so that the first and second discharge wires are arranged parallel to one another along a substantial center in a width direction of the grid.

19 Claims, 11 Drawing Sheets

IMAGE FORMING APPARATUS

BRIEF SUMMARY OF THE INVENTION

1. Technical Field

The present invention relates to an image forming apparatus, and more particularly, to an image forming apparatus including a removable process cartridge.

2. Background Art

An electrophotographic image forming apparatus is widely used. Description is made of an image forming process of such an image forming Apparatus. First, a surface of a photosensitive drum is uniformly charged. Next, the photosensitive drum is irradiated with light based on image data, to thereby change the charging state of the surface of the photosensitive drum. Next, toner is caused to adhere in accordance with the charging state. Next, the adhering toner is transferred onto a recording medium. The surface of the photosensitive drum is cleaned, and the above-mentioned steps from the charging are continued again. The toner transferred onto the recording medium is fixed by heat and pressure. In this manner, an image based on the image data is formed, on the recording medium.

There is known a charger for uniformly charging the surface of the photosensitive drum, which includes a discharge wire. The discharge wire deteriorates as a result oil repetitive discharging. Under this state, normal discharging is no longer possible. Such a deteriorated discharge wire needs to be replaced. For example, the deteriorated discharge wire is disengaged to replace it with a new discharge wire. Alternatively, the entire charger is replaced.

For example, in the conventional technology described in JP 2009-251382 A, there is proposed an image forming apparatus capable of promptly replacing the discharge wire. That is, a discharger includes a wire unit including a plurality of stretched discharge wires, a rotating portion for rotating the wire unit by receiving a drive force to cyclically change the positions of the plurality of discharge wires, and a conduction portion to which one of the plurality of discharge wires is electrically connected for electrical continuity when this discharge wire comes to a predetermined discharge position. Power can be selectively fed to the discharge wires by the rotating portion.

CITATION LAST

Patent Literature

[PTL 1] JP 2009-251382 A

However, in the conventional technology, a rotating mechanism, for rotating the wire unit, a drive portion for rotatably driving the wire unit, a control portion for controlling those parts, and the like are necessary. As a result, the apparatus is upsized-due to addition of the rotating mechanism and the like, and further, the power consumption increases because the control portion and the drive portion are newly provided. In society, there are demands for downsizing and power saving of the apparatus, and a smaller and lower power consuming apparatus is desired.

In view of the above-mentioned problems, it is an object of the present, invention to provide an image forming apparatus having good discharge characteristics and maintaining good image quality while being prevented from being upsized, which in capable of promptly replacing the discharge wire.

SUMMARY OF THE INVENTION

According to the present invention, there is provided an image forming apparatus, including: a process cartridge including: a photosensitive drum in which a charging state of a surface is changed by receiving light irradiation; a drum cleaner for cleaning toner adhering on the photosensitive drum; a static eliminator for eliminating static on the surface of the photosensitive drum; and a charger including a plurality of discharge wires, for uniformly charging the surface of the photosensitive drum; an optical head for irradiating the photosensitive drum with light based on image data; a developing device for causing the toner to adhere on the surface of the photosensitive drum in accordance with the charging state; and conveying means for conveying a recording medium in which the process cartridge includes groove portions to which end portions of the charger in a longitudinal direction are fitted, respectively, one of the groove portions, which corresponds to one of the end portions, having a side wall provided with a contact for feeding power to one of the plurality of discharge wires, in which one of the end portions of the charger has an opening portion for bringing a connector plate connected to one of the plurality of discharge wires into contact with the contact, in which another of the end portions of the charger has an opening portion for bringing another connector plate connected to another of the plurality of discharge wires into contact with the contact, and in which any one of the end portions of the charger is fitted to the one of the groove portions provided with the contact.

According to the present invention, it is possible to realise the image forming apparatus having good discharge characteristics and good image formation quality while being prevented from being upsized, which is capable of promptly replacing the discharge wire.

DESCRIPTION OF EMBODIMENT

With reference to the drawings, an embodiment of the present invention is described.

Figure 1:
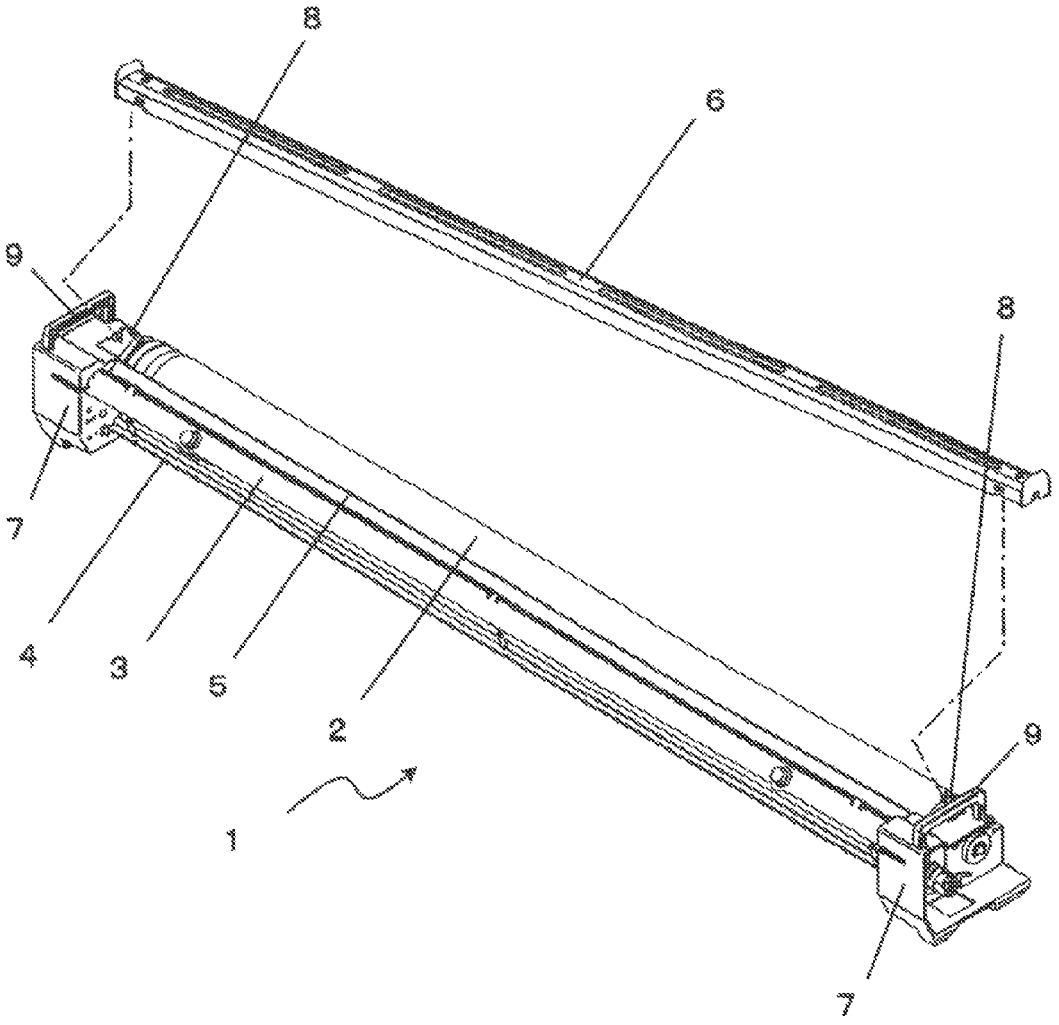
FIG. 1 is a perspective view illustrating a process cartridge and a charger.
Figure 2:
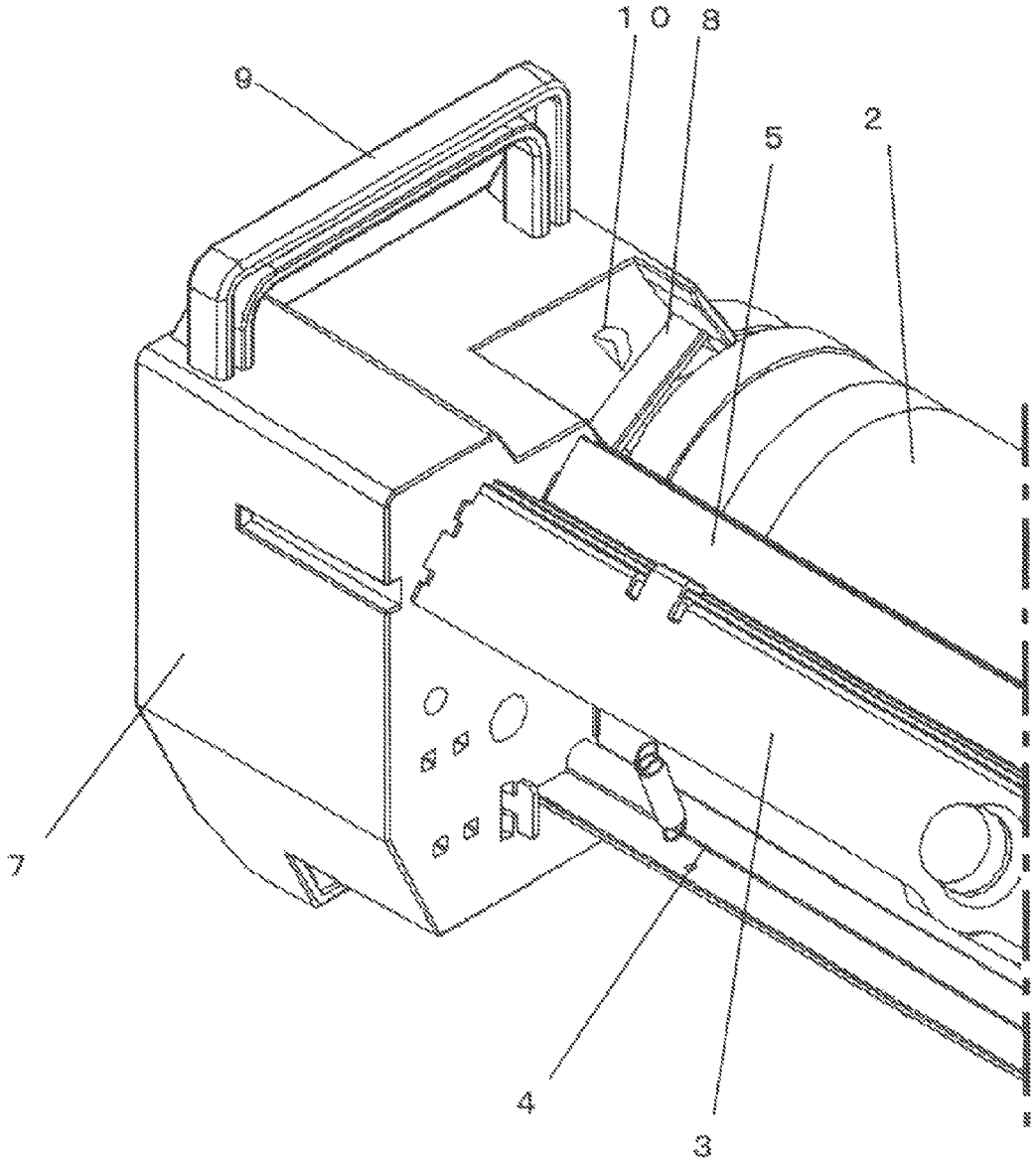
FIG. 2 is a partial enlarged view illustrating a charger mounting groove of the process cartridge.

FIG. 1 is a perspective view illustrating a process cartridge and a charger. FIG. 2 is a partial enlarged view illustrating a charger mounting groove of the process cartridge. A process cartridge 1 includes a photosensitive drum 2, a drum cleaner 3, a stripper 4, a static eliminator 5, and a charger 6. The photosensitive drum 2 is irradiated with light in accordance with, image data to change the charging state of its surface. Toner adheres in accordance with the charging state of the surface, and the toner is transferred onto a recording medium. The drum cleaner 3 removes toner remaining in minute amounts without, being transferred from the photosensitive drum 2 to the recording medium, and cleans the photosensitive drum 2. The removed toner is discarded. The stripper 4 is a device for stripping the recording medium from the photosensitive drum 2 when the recording medium after transfer attaches to the photosensitive drum 2. The static eliminator 5 is a device for completely eliminating static on the surface of the photosensitive drum 2 once. The charger 6 is a device for uniformly charging the surface of she photosensitive drum 2. The photosensitive drum 3, the drum cleaner 3, the stripper 4, and the static eliminator 5 are fixed to a frame 7.

In the frame 7 on a lateral side of the static eliminator 5, mounting grooves 8 for removably mounting the charger 6 are formed. The charger 6 is fitted into the mounting grooves 8 to be mounted. At one of the mounting grooves 8, a contact 10 for feeding power to the charger 6 is arranged. The charger 6 includes two discharge wires, but power is fed to only one of those discharge wires by the contact 10. When the direction of the charger 6 is changed by 180 degrees so that an end portion on the opposite side is connected, to the contact, power is fed to the other discharge wire. When the mounting direction of the discharge wire is changed, power is fed to one of the discharge wires.

At both ends of the frame 7, grips 3 for handling the process cartridge 1 are provided. A user holds those grips 9 to mount the process cartridge 1 to an apparatus. The mounting grooves 8 for mounting the charger 6 are provided at positions between the grips 9. The mounting grooves 8 are present between the grips 9, and hence the charger 6 can be replaced even in a state where the process cartridge 1 is mounted to the apparatus.

Figure 3:
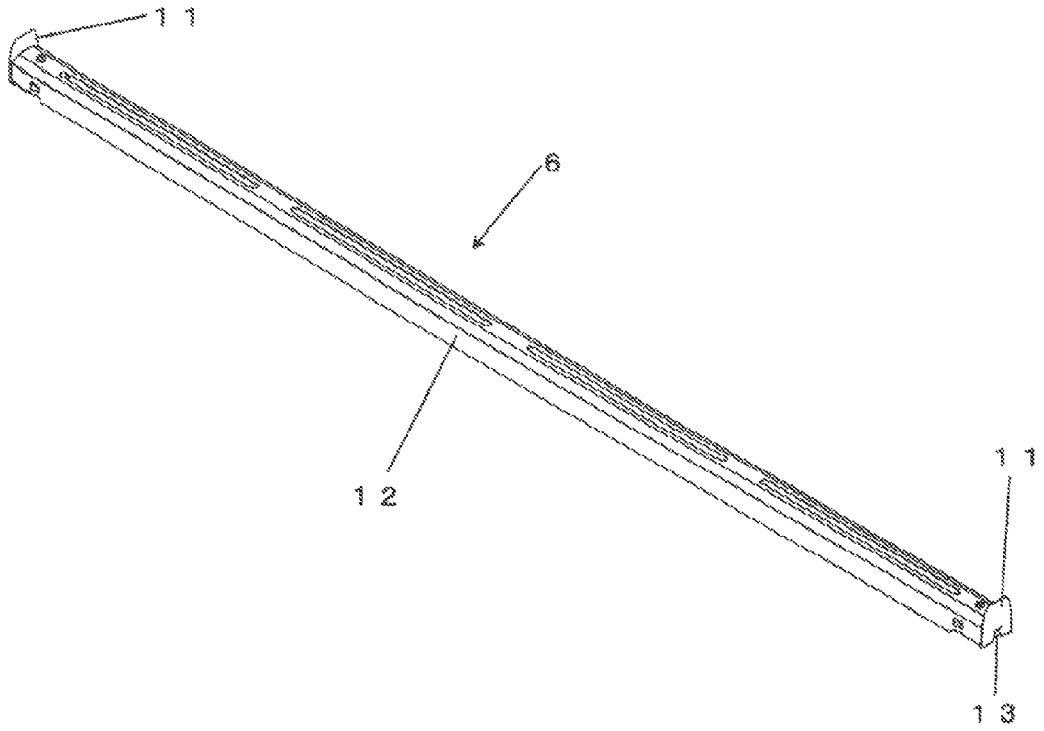
FIG. 3 is a perspective view of the charger as viewed from above.
Figure 4:
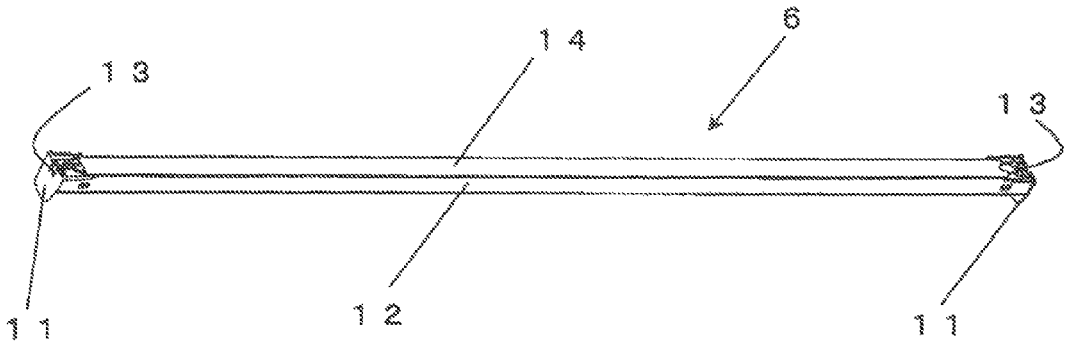
FIG. 4 is a perspective view of the charger as viewed from below.

FIG. 3 is a perspective view of the charger as viewed from above. FIG. 4 is a perspective view of the charger as viewed from below. At both ends of the charger 6, there are providers holding portions 11 to be held when the charger 5 is mounted and removed to and from the mounting grooves 8. Each of the holding portions 11 is provided with a power feeding hole 13. When the contact 10 is inserted through the power feeding hole 13, power is fed to the discharge wire. A metal frame 11 of the charger 6 is a metallic frame. A grid 14 is removably mounted at a position at which the charger 6 is to be opposed to the photosensitive drum 2.

In a case where the charger 6 is mounted to the process cartridge 1, the user can hold the grips 9 because the holding portions 11 do not overlap with the grips 9. The holding portions 11 protrude from the frame 7 when the charger 6 is mounted, but the holding portions 11 do not obstruct the holding of the grips 9.

Figure 5:
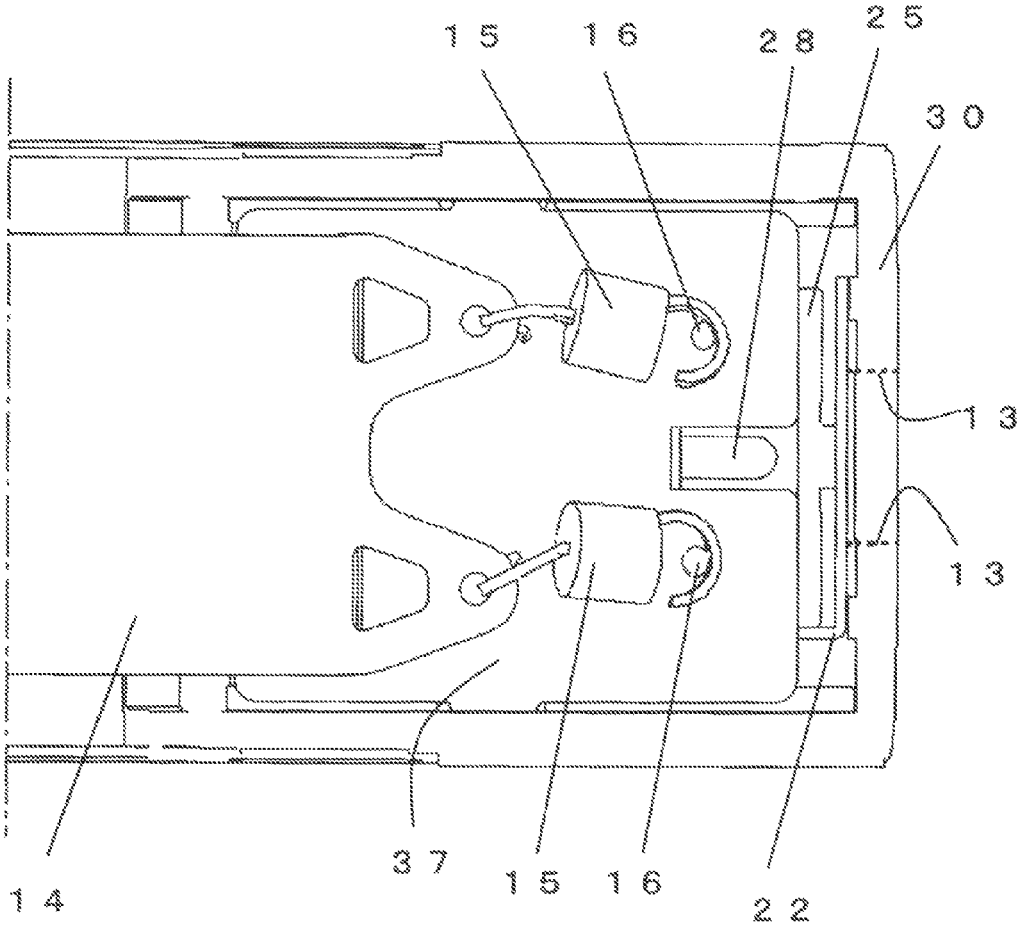
FIG. 5 is a view illustrating a grid mounting portion of the charger.
Figure 6:
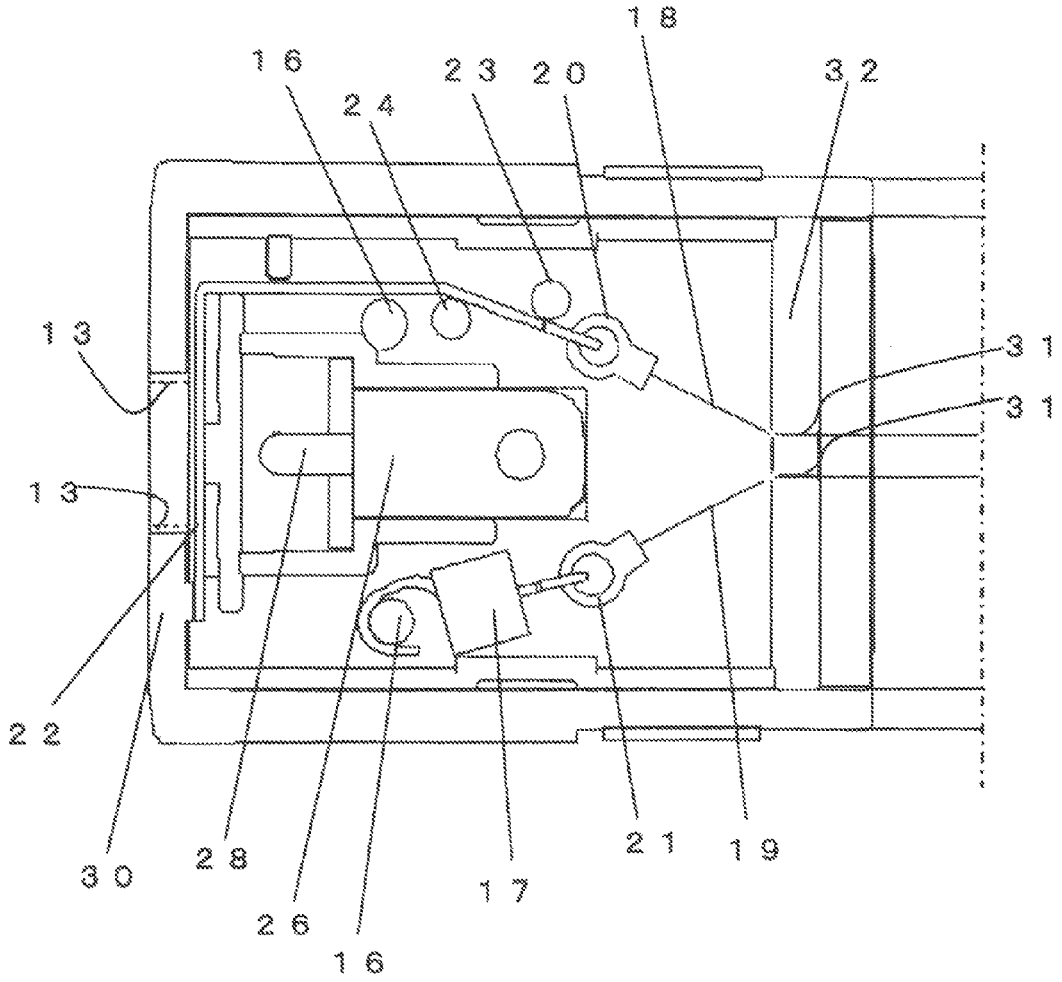
FIG. 6 is a view illustrating a discharge wire mounting portion of the charger.
Figure 7:
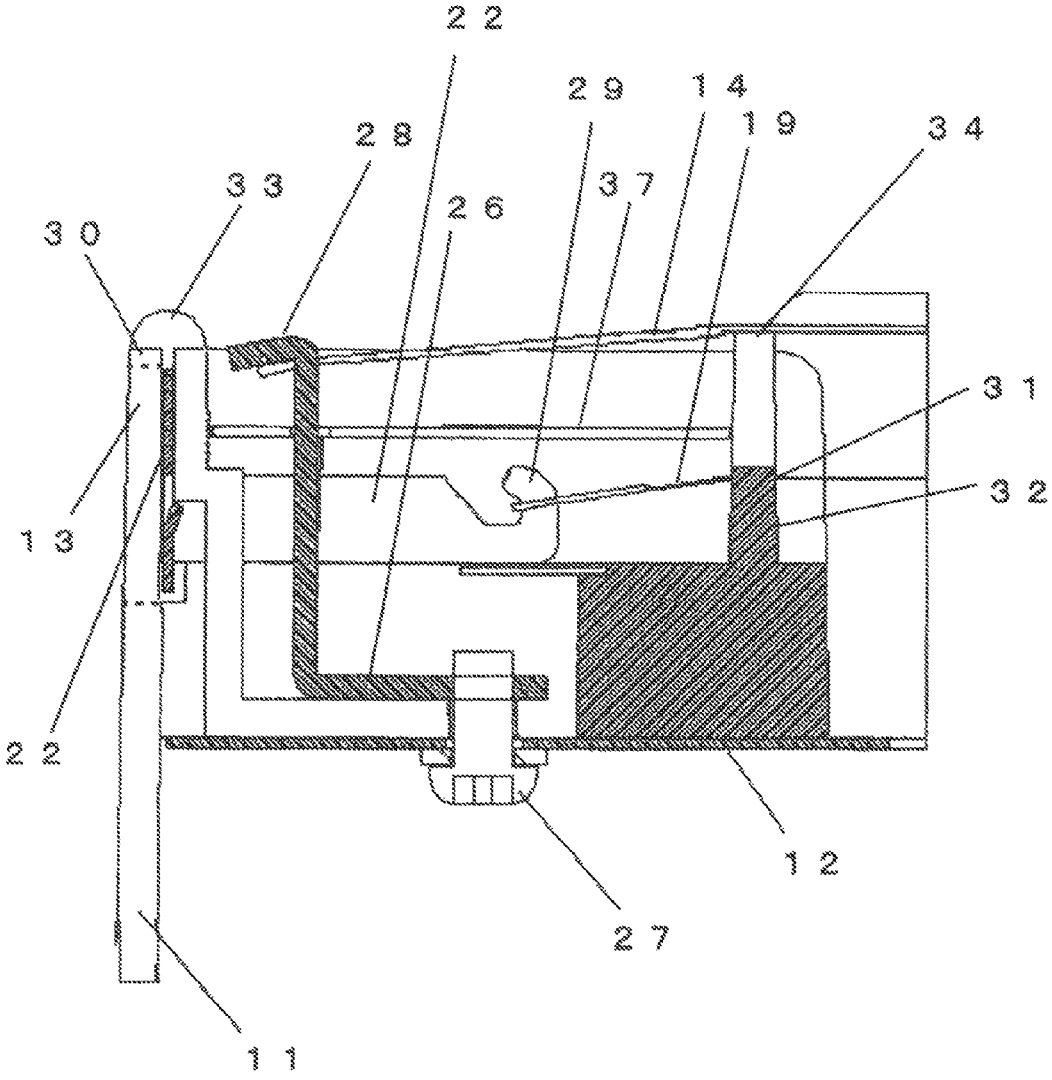
FIG. 7 is a sectional view illustrating the grid mounting portion and the discharge wire mounting portion of the charger.

FIG. 5 is a view illustrating a grid mounting portion of the charger. FIG. 6 is a view illustrating a discharge wire mounting portion of the charger. FIG. 7 is a sectional view illustrating the grid mounting portion and the discharge wire mounting portion of the charger. A first discharge wire 18, a second discharge wire 19, and the grid 14 are removably mounted to the charger 6. Each of those members is mounted at both end portions of the charger 6, and each of the first discharge wire 18 and the second discharge wire 19 has the same configuration in both sides of the end portions. End portions of the grid 14 have different shapes. One end portion has two mounting holes, and the other end portion has one mounting hole. A plurality of pins are formed in a frame portion 30 of the charger 6. Pins 16 are pins for retaining springs 15 and 17. Pins 23 and 24 are pins for positioning a connector plate 22. The connector plate 22 is a metallic plate for connecting the first discharge wire 18 and the contact 10. The connector plate 22 has one end provided with a hook 29 which is hooked to a circular catch 20 of the first discharge wire 18. The first discharge wire 18 is biased by a spring in a direction separating from the connector plate 22. The connector plate 22 is fixed in a manner fitted between an erect portion 25 and the frame portion 30. The connector plate 22 and the contact 10 are brought into contact with each other via the power feeding hole 13 provided in the frame portion 30.

The grid 14 is retained by the pine 16 via the springs 15. The springs 15 each have one end retained through engagement with a through hole opened in the grid 14, and the other end retained through engagement with the pin 16 provided to the charger 6. An insulating plate 37 is arranged on the back side of the grid 14 and the springs 15. On the back side of the insulating plate 37, there is a space in which the discharge wires are retained. Alternatively, the two springs 15 for the grid 14 may be retained by a bent portion 28 instead of the pins 16.

The second discharge wire 13 has one end provided with a catch 21. The spring 17 is hooked to the catch 21, and further, the other end of the spring 17 is hooked to the pin 16. The second discharge wire 19 is pulled by the spring 17.

The first discharge wire 18 and the second discharge wire 19 are fitted to a groove 31 provided, in a wire fixing portion 32. The groove 31 positions the first discharge wire 18 and the second discharge wire 19.

At one end portion of the charger 6, the first, discharge wire 18 and the contact 10 establish electrical continuity via the connector plate 22. At the other end portion of the charger 6, the second discharge wire 19 and the contact 10 establish electrical continuity via the connector plate 23.

The grid 14 is hooked to the bent portion 28 at one end portion of a power feeding plate 26. The power feeding plate 26 has the other end portion fixed to the metal frame 12 by a screw 27, and the metal frame 12 and the grid 14 establish electrical continuity. On the side of the frame portion 30 opposite to the holding portion 11, an abutment portion 33 which abuts against a bottom portion of the mounting groove 8 is formed. The grid 14 has the end portion hooked to the bent portion 23, and is brought into contact with, a surface of a leading end of a grid height adjusting, wall 34. The leading end of the grid height, adjusting wall 34 is formed flat. The other end portion of the grid 14 is pulled by the spring to maintain the stretched state. The leading end of the grid height adjusting wall 34 and a leading end of the abutment portion 33 has a difference in height that is adjusted in advance so as to optimise the distance of the grid 14 with respect to the photosensitive drum 2. The "height" referred, herein is the distance from the photosensitive drum.

An angle of the first discharge wire 18 with respect to the wire fixing portion 32 and an angle of the second discharge wire 19 with respect to the wire fixing port ion 32 are symmetrical. The pins 23 and 24 are provided so that a direction of the pin 16 from the wire fixing portion 32 and the groove 31 and a direction of the connector plate 22 from the wire fixing portion 32 and the groove 31 are symmetrical.

The other end portion of the first discharge wire 18 illustrated in FIG. 6 has the same mounting structure as that of the second discharge wire 19 illustrated in FIG. 6. Further, the other end portion of the second discharge wire 19 illustrated in FIG. 6 has the same mounting structure as that of the first discharge wire 18 illustrated in FIG. 6. As described above, both end portions of the charger 6 are symmetrical.

Figure 8:
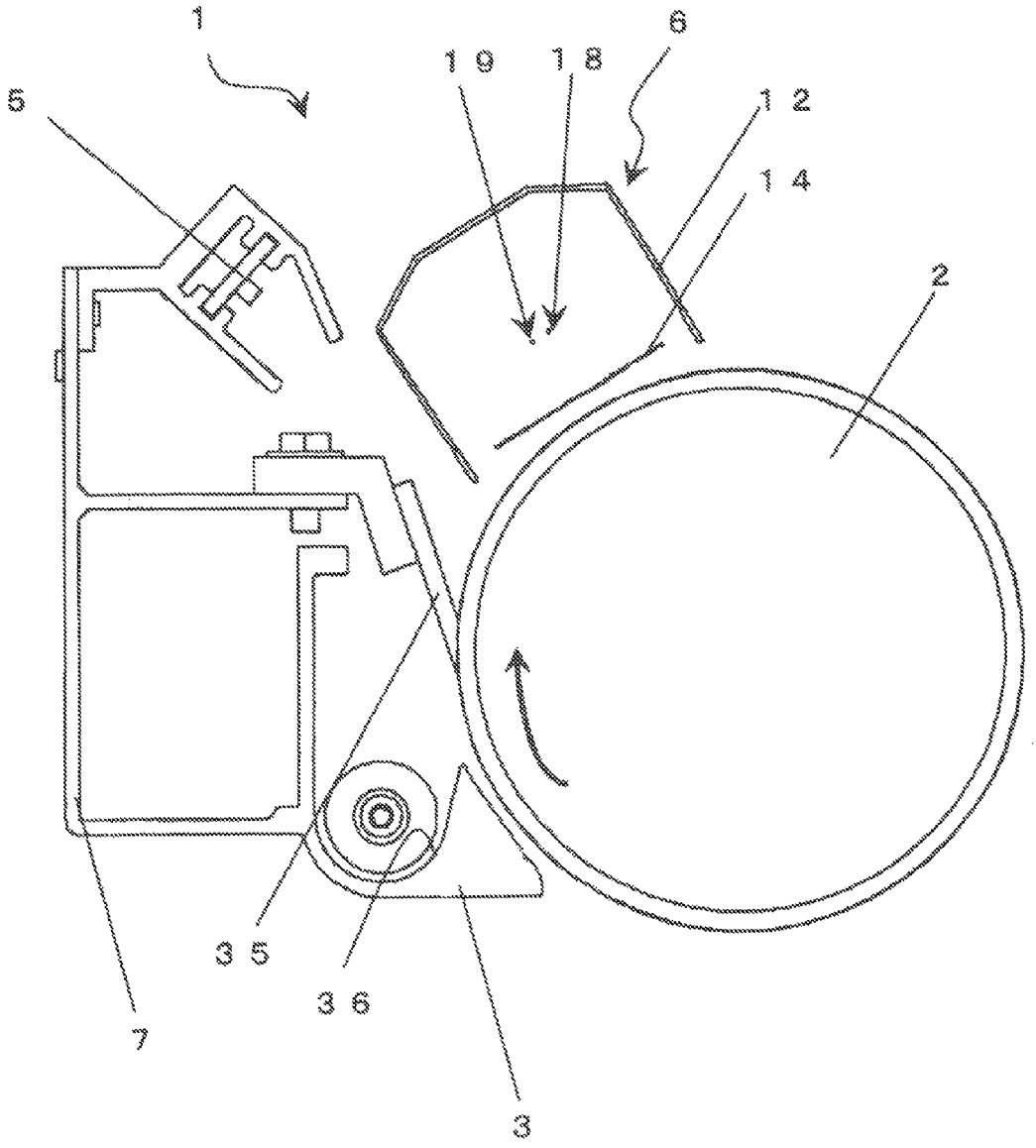
FIG. 8 is a schematic view illustrating a configuration of the process cartridge.

FIG. 8 is a schematic view illustrating a configuration of the process cartridge. The photosensitive drum 2 of the process cartridge 1 rotates in an arrow direction. The adhering toner is scraped off by a blade 35. The fallen toner is collected in a waste toner receiver 36 of the drum cleaner 3. The drum cleaner 3 and the static eliminator 5 are fixed to the frame 7. A voltage of several kilovolts is applied to the first discharge wire 18 when the process cartridge 1 is used. The voltage to be applied is preferably 5 to 7 kilovolts. A voltage of 400 volts is applied to the grid 14 and the metal frame 12. The absolute value of the voltage applied to the grid 14 and the metal frame 12 is lower than that applied to the first discharge wire 18. The charger 6 uniformly charges the surface of the drum 2. Even when a voltage is applied to the second discharge wire 19, the voltage is applied similarly to the case of the first discharge wire 18. Even when arrangement is made to apply a voltage to the second discharge wire 19, the positional relationship between the photosensitive drum 2 and the second discharge wire 19 as well as the grid 14 and the positional relationship between the photosensitive drum 2 and the first discharge wire 18 as well as the grid 14 are the same.

Figure 9:
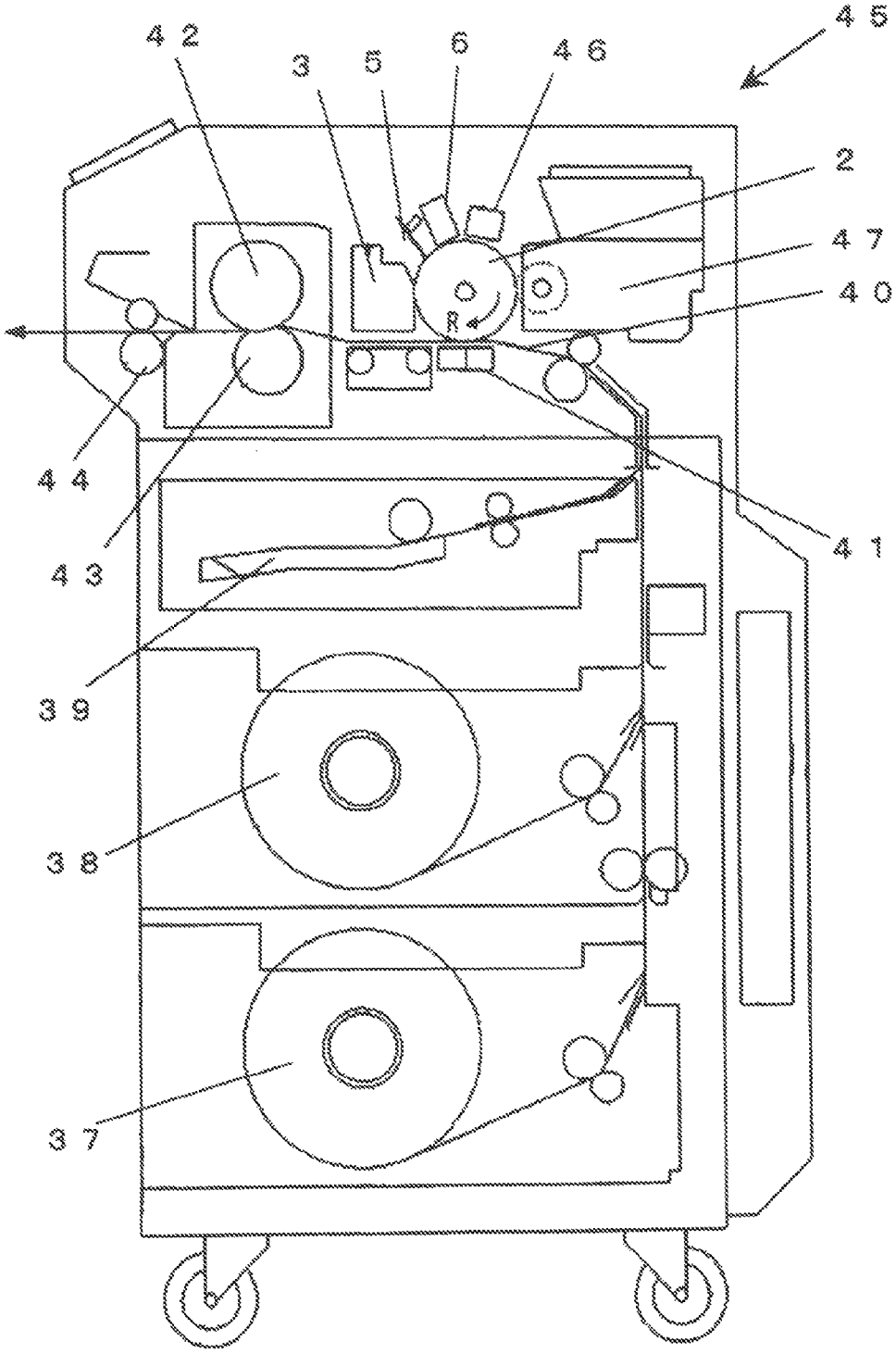
FIG. 9 is a schematic view illustrating a configuration of an image forming apparatus.

FIG. 9 is a schematic view illustrating a configuration of an image forming apparatus. An image forming apparatus 45 selects a recording medium from roll paper 37, 38, or cut paper 39, and conveys the recording medium. Onto a conveyed, recording medium 40, toner is transferred from the photosesitive drum 2. The toner on the photosensitive drum 2 adsorbs on the recording medium 40 by the static of a transfer device 41. The toner adhering on the recording medium 40 is nipped by a high-temperature fixing roller 42 and a pressure roller 43 to be fixed onto the recording medium 40 by heat and pressure. After that, the recording medium 40 is discharged outside the apparatus by a delivery roller 44. An optical head 46 is a device for applying light to the photosensitive drum 2 based on the image data, to thereby change the charging state of the surface thereof. A developing device 47 is a device for causing toner to adhere in accordance with the charging state of the surface of the photosensitive drum 2. As described above, the image forming apparatus 45 records an image on various types of recording medium 40 based on the image data.

Figure 10:
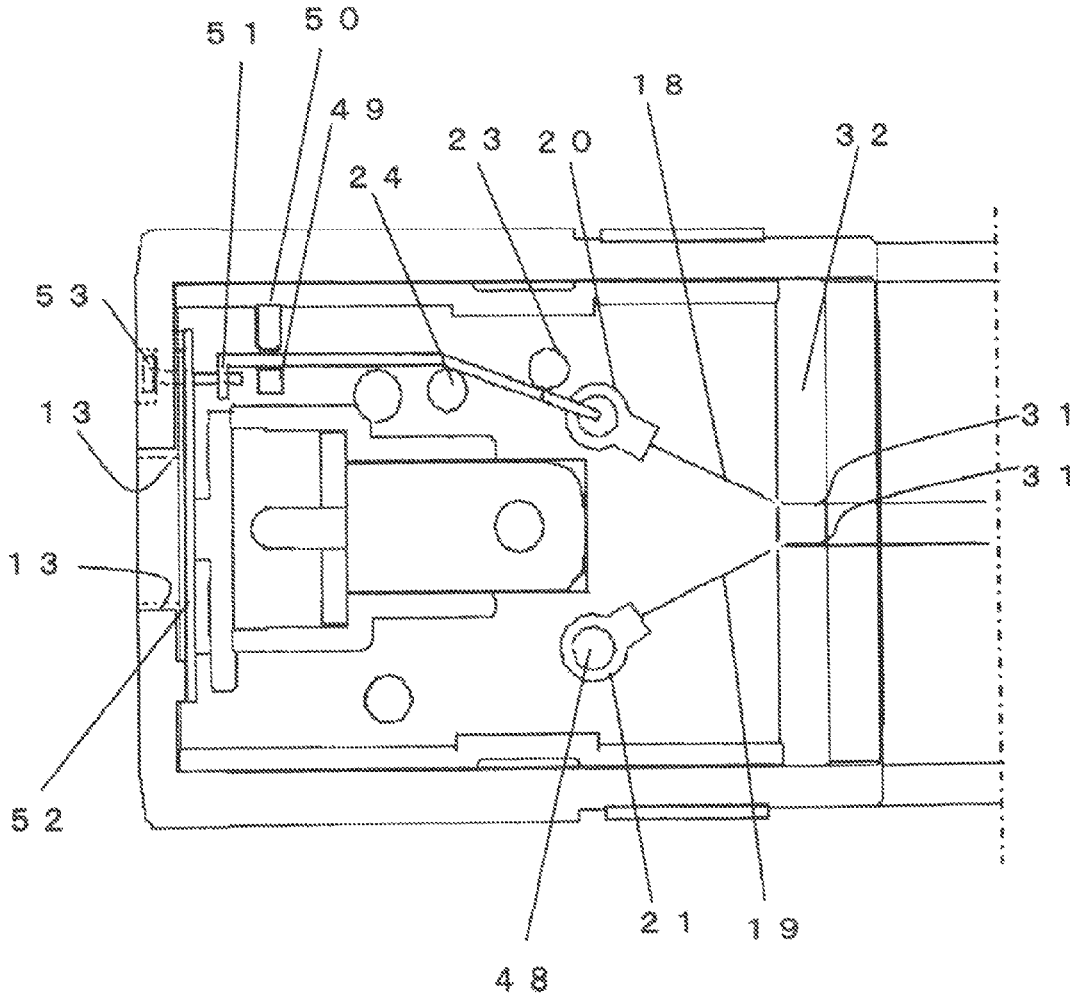
FIG. 10 is a view illustrating a discharge wire mounting portion in another form.

FIG. 10 is a view illustrating a discharge wire mounting portion in another form, which is a mechanisms for stretching the discharge wire 18 without using a spring. When the discharge wire is loose, the distance with respect to the grid 14 becomes variable, which leads to non-constant charging and affects the image quality. Therefore, it is required to arrange the discharge wire at a predetermined position in a stretched state. The two discharge wires 18 and 19 are mounted to the charger 6. The other end portion of the first discharge wire 18 has the same mounting structure as the one end portion of the second discharge wire 17. Further, the other end portion of the second discharge wire 19 has the same mounting structure as the first discharge wire 18. As described, above, both the end portions of the charger 6 are symmetrical.

The catch 21 of the second discharge wire 19 is looped to a pin 48 to be fixed to a casing of the charger 6. The catch 20 of the first discharge wire 18 is looped to a hook provided at one and of a second connector plate 51. The other end of the second connector plate 51 is bent into an L-shape, and is provided with a screw hole. A screw 53 is inserted through the screw hole. Through rotation of the screw 53, the second connector plate 51 moves with respect to the casing of the charger 6. That is, the second connector plate 51 is moved to stretch or loosen the first discharge wire 18. A first connector plate 52 is exposed via the power feeding hole 13, and can be brought into contact with the contact 10. Power is fed to the first discharge wire 18 from the contact 10 via the first connector plate 52, the screw 53, the second connector plate 51, and the catch 20. When the charger 6 is used, the used one or the first discharge wire 18 and the second discharge wire 19 is stretched so as to be tensioned in the longitudinal direction.

A first protrusion 49 and a second protrusion 30 restrict the movement of the second connector plate 51 so that the second connector plate 51 moves in parallel to the axial direction of the screw 53. The second connector plate 51 is tinted between the pins 23 and 24 arranged obliquely with respect to the protrusions. When the second connector plate 51 moves in the axial direction of the screw 53 in a direction to stretch the first discharge wire 18, the movement of the second connector plate 51 between the pins 23 and 24 is restricted to a positional direction between the pins with respect to the axial direction of the screw 53. Thus, the second connector plate 31 is warped, to thereby stretch the first discharge wire 18 for firm fixation. That is, the first discharge wire 18 is stretched and firmly fixed. As described above, the charger 6 can stretch the first discharge wire 18 by including movement means for moving the second connector plate 51, and simultaneously, establishes electrical connection between the contact 10 and the first discharge wire 18.

Figure 11:
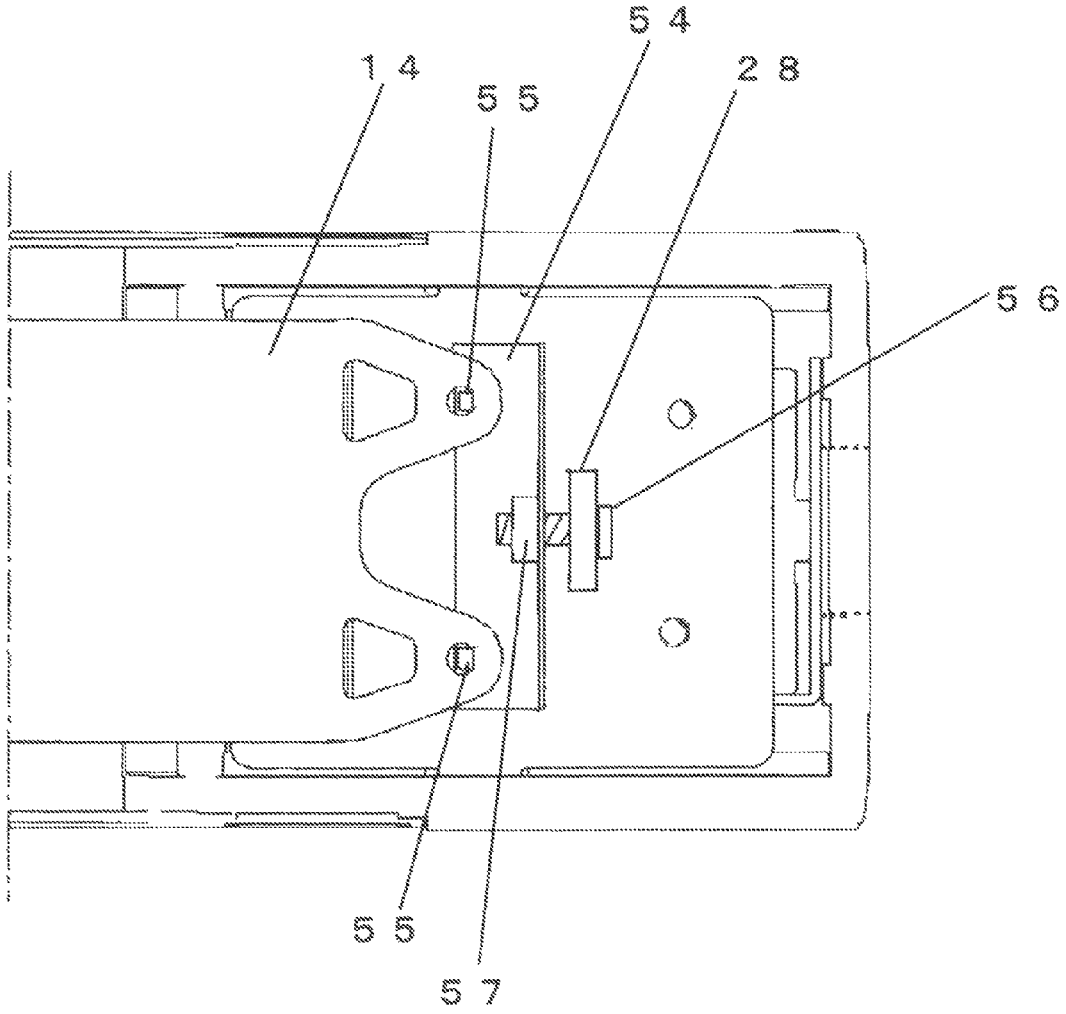
FIG. 11 is a view illustrating a grid mounting portion in another form.

FIG. 11 is a view illustrating a grid mounting portion in another form. As illustrated in FIG. 7, one end of the grid 14 is hooked to the bent portion 28 to be fixed. That is, the grid 14 is in a fixed state with respect to the casing. The other end has two holes, and the holes are looped to projecting portions 55 of a movable plate 54. The projecting portions 55 are formed by bending ends of the movable plate 54. The movable plate 54 is movable in a stretching direction of the grid 14. The bent portion 28 is provided with a hole. A bolt 56 passes through the hole of the bent portion 28 and a hole provided in the movable plate 54, and is fixed by a nut 57. Through rotation of the nut 57, the movable plate 54 moves to stretch the grid 14. When the grid 14 is loose, the distance with, respect to the photosensitive drum 2 becomes variable, which leads to non-constant charging and affects the image quality. Alternatively, without using the bolt 56 and the nut 57, a screw hole may be opened in the movable plate 54, and the bolt 56 may pass through the screw hole to move the movable plate 54. As described above, relay means for stretching the grid 14 may be interposed, and the relay means may be moved with respect to the casing to stretch the grid 14. Further, movement means for moving the position of the relay means such as a screw, a bolt, and a nut may be provided, to thereby stretch the grid 14 in the longitudinal direction without using a spring.

INDUSTRIAL APPLICABILITY

The present invention is applicable to an image forming apparatus for conveying a recording medium and recording an image on the recording medium.

REFERENCE SIGNS LIST

1 process cartridge
2 photosensitive drum
3 drum cleaner
4 stripper
5 static eliminator
6 charger
7 frame
8 mounting groove
9 grip
10 contact
11 holding portion
12 metal frame
13 power feeding hole

14 grid
15 spring
16 pin
17 spring
18 first discharge wire
19 second discharge wire
20 catch
21 catch
22 connector plate
23 pin
24 pin
25 erect portion
26 power feeding plate
27 screw
28 bent portion
29 hook
30 frame portion
31 groove
32 wire fixing portion
33 abutment portion
34 grid height adjusting wall
35 blade
36 toner receiver
37 insulating plate
37 roll paper
38 roll paper
39 cut paper
40 recording medium
41 transfer device
42 roller
43 pressure roller
44 after delivery roller
45 image forming apparatus
46 optical head
47 developing device

The invention claimed is:

1. An image forming apparatus, comprising:

a process cartridge comprising:

a photosensitive drum in which a charging state of a surface is changed by receiving light irradiation;

a drum cleaner for cleaning toner adhering on the photosensitive drum;

a static eliminator for eliminating static on the surface of the photosensitive drum; and a charger for uniformly charging the surface of the photosensitive drum, the charger including two discharge wires;

an optical head for irradiating the photosensitive drum with light based on image data;

a developing device for causing the toner to adhere on the surface of the photosensitive drum in accordance with the charging state; and conveying means for conveying a recording medium;

wherein the process cartridge further comprises a frame having two groove portions in which respective end portions of the charger in a longitudinal direction are fitted to removably mount the charger to the frame, only one of the groove portions having a side wall provided with a contact for feeding power to one of the discharge wires of the charger when any one of the end portions of the charger is fitted in the one of the groove portions;

wherein the charger and the frame of the process cartridge are configured so that in a first position of the charger relative to the frame, one of the end portions of the charger is fitted in the one of the groove portions of the frame and the contact feeds power to only one of the two discharge wires, and so that in a second position of the charger differing by 180 degrees relative to the first position, the other of the end portions of the charger is fitted in the one of the groove portions of the frame and the contact feeds power to only the other of the discharge wires;

wherein the one of the end portions of the charger has an opening portion for bringing a connector plate connected to the one of the discharge wires into contact with the contact of the one of the groove portions;

wherein the another of the end portions of the charger has another opening portion for bringing another connector plate connected to the other of the discharge wires into contact with the contact of the one of the groove portions; and wherein the charger comprises a metal frame, a grid mounted on the metal frame and configured to be positioned opposite to the photosensitive drum, and two wire fixing portions each having two grooves extending along a substantial center in a width direction of the grid, the one of the discharge wires being fitted in one of the two grooves of each of the wire fixing portions, and the other of the discharge wires being fitted in the other of the two grooves of each of the wire fixing portions so that the two discharge wires are arranged parallel to one another along the substantial center in the width direction of the grid.

2. The image forming apparatus according to claim 1, wherein each of the discharge wires is configured to be applied with a voltage having a first potential while the metal frame and the grid are configured to be applied with a voltage having a second potential that is smaller than the first potential.

3. The image forming apparatus according to claim 2, wherein the charger further comprises: relay means for stretching the grid; and movement means for moving the relay means in the longitudinal direction of the grid; wherein the grid has one end fixed to a casing of the charger and another end connected to the relay means; wherein the movement means causes the relay means to stretch the grid in the longitudinal direction; and wherein the grid and the metal frame are electrically connected to each other via the relay means and the movement means.

4. The image forming apparatus according to claim 3, wherein each of the connector plate and the another connector plate comprises: a first connector plate to be brought into contact with the contact; and a second connector plate connected to a corresponding one of the discharge wires; wherein each of the discharge wires has one end fixed to a casing of the charger and another end connected to the second connector plate; wherein the charger comprises moving means for moving the second connector plate to stretch the corresponding one of the discharge wires in the longitudinal direction, and for establishing an electrical connection between the first connector plate and the second connector plate.

5. The image forming apparatus according to claim 2, wherein the discharge wires of the charger are each stretched by a spring.

6. The image forming apparatus according to claim 2, wherein the process cartridge comprises grips at both ends thereof configured to be grasped by a user; wherein the charger comprises holding portions at both end portions thereof configured to be grasped by the user; wherein the groove portions are formed between the grips; and wherein when the charger is mounted to the process cartridge, the grips are located on outer sides of the charger in the longitudinal direction, and the holding portions and the grips are arranged at a distance from each other.

7. The image forming apparatus according to claim 2, wherein each of the connector plate and the another connector plate comprises: a first connector plate to be brought into contact with the contact; and a second connector plate connected to a corresponding one of the discharge wires; wherein each of the discharge wires has one end fixed to a casing of the charger and another end connected to the second connector plate; wherein the charger comprises moving means for moving the second connector plate to stretch the corresponding one of the discharge wires in the longitudinal direction, and for establishing an electrical connection between the first connector plate and the second connector plate.

8. The image forming apparatus according to claim 1, wherein the discharge wires of the charger are each stretched by a spring.

9. The image forming apparatus according to claim 8, wherein the process cartridge comprises grips at both ends thereof configured to be grasped by a user; wherein the charger comprises holding portions at both end portions thereof configured to be grasped by the user; wherein the groove portions are formed between the grips; and wherein when the charger is mounted to the process cartridge, the grips are located on outer sides of the charger in the longitudinal direction, and the holding portions and the grips are arranged at a distance from each other.

10. The image forming apparatus according to claim 1, wherein the process cartridge comprises grips at both ends thereof configured to be grasped by a user; wherein the charger comprises holding portions at both end portions thereof configured to be grasped by the user; wherein the groove portions are formed between the grips; and wherein when the charger is mounted to the process cartridge, the grips are located on outer sides of the charger in the longitudinal direction, and the holding portions and the grips are arranged at a distance from each other.

11. The image forming apparatus according to claim 1, wherein each of the connector plate and the another connector plate comprises: a first connector plate to be brought into contact with the contact; and a second connector plate connected to a corresponding one of the discharge wires; wherein each of the discharge wires has one end fixed to a casing of the charger and another end connected to the second connector plate; wherein the charger comprises moving means for moving the second connector plate to stretch the corresponding one of the discharge wires in the longitudinal direction, and for establishing an electrical connection between the first connector plate and the second connector plate.

12. An image forming apparatus comprising:

a process cartridge comprised of a frame, a photosensitive drum mounted on the frame, a drum cleaner mounted on the frame for cleaning toner adhering on the photosensitive drum, a static eliminator mounted on the frame for eliminating static on a surface of the photosensitive drum, a charger having two discharge wires and being removably mounted on the frame for uniformly charging the surface of the photosensitive drum, mounting grooves formed on the frame and to which respective end portions of the charger are fitted for removably mounting the charger to the frame, and a contact disposed in only one of the mounting grooves for feeding power to only one of the discharge wires of the charger when any one of the end portions of the charger is fitted to the one of the mounting grooves, the charger and the frame being configured so that in a first position of the charger relative to the frame, one of the end portions of the charger is fitted in the one of the mounting grooves and the contact feeds power to only one of the discharge wires, and so that in a second position of the charger differing by 180 degrees relative to the first position, another of the end portions of the charger is fitted in the one of the mounting grooves and the contact feeds power to only the other of the discharge wires;

an optical head for irradiating the surface of the photosensitive drum with light to change a charging state thereof; and a developing device for causing the toner to adhere on the surface of the photosensitive drum in accordance with a charging state of the surface of the photosensitive drum;

wherein the charger comprises a metal frame, a grid mounted on the metal frame and configured to be positioned opposite to the photosensitive drum, and two wire fixing portions each having two grooves extending along a substantial center in a width direction of the grid, the one of the discharge wires being fitted in one of the two grooves of each of the wire fixing portions, and the other of the discharge wires being fitted in the other of the two grooves of each of the wire fixing portions so that the two discharge wires are arranged parallel to one another along the substantial center in the width direction of the grid.

13. The image forming apparatus according to claim 12, wherein the one of the end portions of the charger has an opening portion for bringing a connector plate connected to the one of the discharge wires into contact with the contact of the process cartridge.

14. The image forming apparatus according to claim 13, wherein the another of the end portions of the charger has another opening portion for bringing another connector plate connected to the other of the discharge wires into contact with the contact of the process cartridge.

15. The image forming apparatus according to claim 12, wherein each of the discharge wires of the charger is configured to be applied with a voltage having a first potential and the metal frame and the grid are configured to be applied with a voltage having a second potential smaller than the first potential.

16. The image forming apparatus according to claim 15, wherein the charger further comprises relay means for stretching the grid and movement means for moving the relay means in the longitudinal direction of the grid; wherein the grid has one end fixed to a casing of the charger and another end connected to the relay means; wherein the movement means causes the relay means to stretch the grid in the longitudinal direction; and wherein the grid and the metal frame are electrically connected to each other via the relay means and the movement means.

17. An image forming apparatus comprising:

a frame;

a photosensitive drum mounted on the frame;

a charger for uniformly charging a surface of the photosensitive drum, the charger comprising a grid configured to be positioned opposite to the photosensitive drum, two wire fixing portions each provided with two grooves, a first discharge wire fitted in one of the two grooves of each of the wire fixing portions, and a second discharge wire fitted in the other of the two grooves of each of the wire fixing portions, the two grooves of each of the wire fixing portions being arranged relative to the grid so that the first and second discharge wires are arranged parallel to one another along a substantial center in a width direction of the grid;

mounting grooves formed on the frame and to which respective end portions of the charger are fitted for removably mounting the charger to the frame;

an electrical contact provided in only one of the mounting grooves for feeding power to any one of the first and second discharge wires of the charger;

an optical head for irradiating the surface of the photosensitive drum with light to change a charging state thereof; and a developing device for causing toner to adhere on the surface of the photosensitive drum in accordance with a charging state of the surface of the photosensitive drum;

wherein the charger and the frame are configured so that in a first position of the charger relative to the frame, one of the end portions of the charger is fitted in the one of the mounting grooves and the electrical contact feeds power to only the first discharge wire, and so that in a second position of the charger differing by 180 degrees relative to the first position, the other of the end portions of the charger is fitted in the one of the mounting grooves and the electrical contact feeds power to only the second discharge wire.

18. The image forming apparatus according to claim 17, wherein one end portion of the charger has an opening portion for bringing a connector plate connected to one of the first and second discharge wires into contact with the electrical contact.

19. The image forming apparatus according to claim 18, wherein another end portion of the charger has another opening portion which is capable of bringing another connector plate connected to the other of the first and second discharge wires into contact with the electrical contact.

* * * * *